United States Patent [19]

Doan

[11] Patent Number: 5,040,608

[45] Date of Patent: Aug. 20, 1991

[54] ANCHORABLE PACK-OFF ASSEMBLY AND METHOD OF SEATING THE SAME

[76] Inventor: John Doan, 1015 E. Chestnut, Olney, Ill. 62450

[21] Appl. No.: 507,742

[22] Filed: Apr. 12, 1990

[51] Int. Cl.[5] ..... E21B 33/10; E21B 43/00; F04B 21/04

[52] U.S. Cl. ..... 166/369; 166/68; 166/106; 166/182; 166/196; 166/387; 417/554

[58] Field of Search ..... 166/68, 106, 114, 118, 166/124, 138, 139, 382, 386, 387, 369, 182, 196; 417/487, 550–554

[56] References Cited

U.S. PATENT DOCUMENTS

| | | | |
|---|---|---|---|
| 1,675,100 | 6/1928 | Harris | 166/105 X |
| 1,915,771 | 6/1933 | Wickersham et al. | 166/182 |
| 2,171,479 | 8/1939 | Nixon | 166/138 X |
| 2,221,204 | 1/1940 | Santiago | 166/124 |
| 3,283,821 | 11/1966 | Brown | 166/139 X |
| 3,372,756 | 3/1968 | Muckleroy | 166/105 X |
| 3,436,084 | 4/1969 | Courter | 166/138 X |
| 3,479,958 | 11/1969 | Anderson et al. | 417/554 X |
| 3,945,774 | 3/1976 | Doan | 417/554 |
| 4,742,874 | 5/1988 | Guillion | 166/182 X |

FOREIGN PATENT DOCUMENTS

| | | | |
|---|---|---|---|
| 724775 | 3/1980 | U.S.S.R. | 166/196 |

*Primary Examiner*—Hoang C. Dang

[57] ABSTRACT

Anchoring of a pack-off assembly of an oil well pump is improved by the provision of a tapered conical sleeve as a wedge for a friction seating ring which is forced outwardly against the inner surface of the pump barrel upon advancement of a nut carried on the end of the pack-off assembly. In addition, downward movement of the pack-off assembly in response to fluid pound is limited by the provision of the pump barrel as two separate pieces joined together with a coupling which includes a tapered section slightly reducing the cross section of the barrel but which permits passage of the lower piston by compressing spring-type seals carried by the piston as it passes through the reduced cross section.

12 Claims, 1 Drawing Sheet

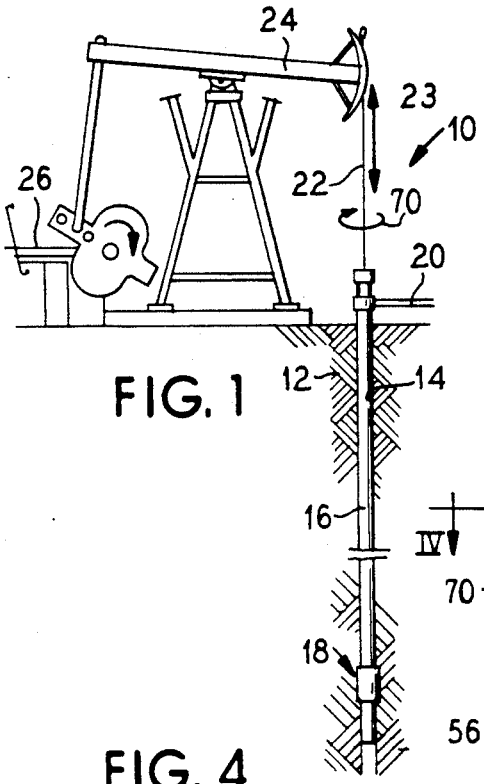
FIG. 1
FIG. 2
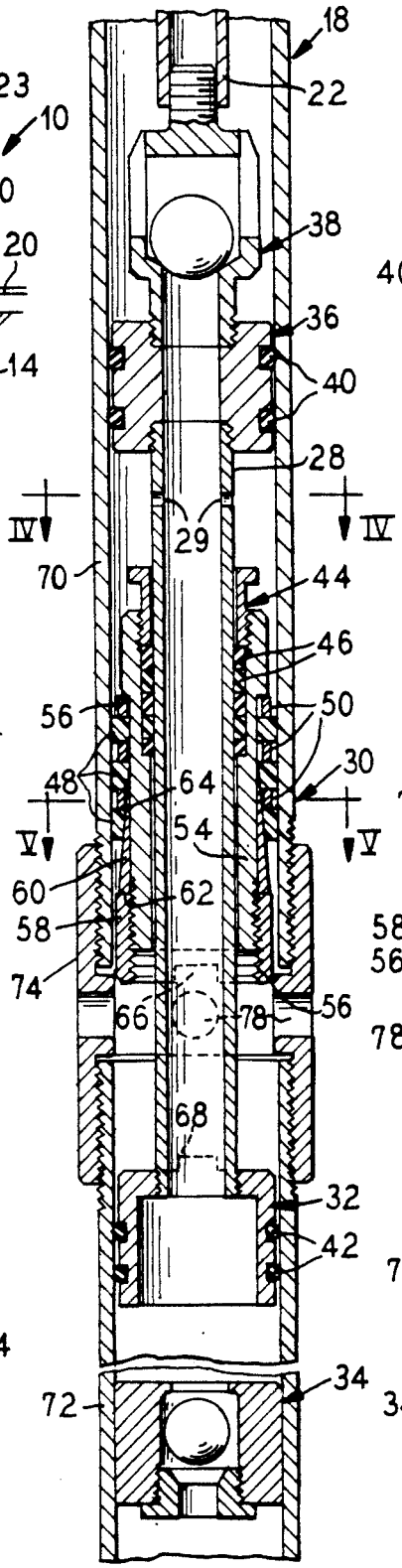
FIG. 3
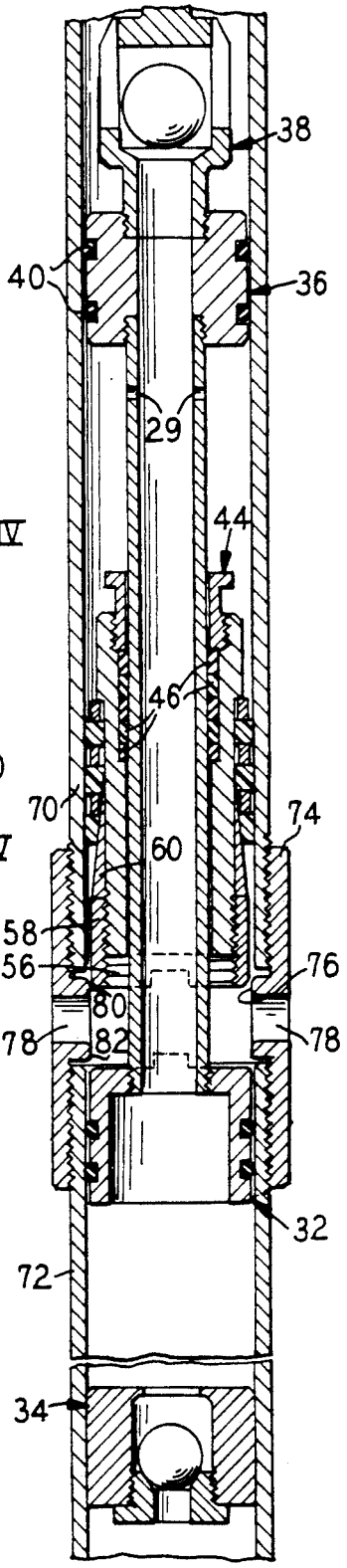
FIG. 4
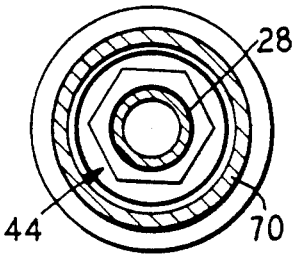
FIG. 5
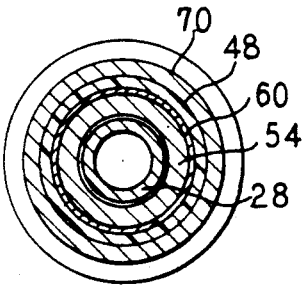

ANCHORABLE PACK-OFF ASSEMBLY AND METHOD OF SEATING THE SAME

INCORPORATION BY REFERENCE

This application incorporates material by reference, namely to U.S. Pat. No. 3,945,774, issued on Mar. 23, 1976.

BACKGROUND OF THE INVENTION

1. Field of the Invention:

The present invention relates to well pump apparatus, and in particular to an anchorable pack-off assembly and a method for seating the assembly for use within the tubing of a well, in particular an oil well, and to well pump apparatus in which the effects of fluid pound are countered.

2. Description of the Prior Art

My U.S. Pat. No. 3,945,774, which is fully incorporated herein by this reference, discloses an anchorable pack-off assembly for use in the well tubing of an oil well, in which the tubing constitutes an outer pump casing (pump barrel). The pack-off assembly is included in a structure in which first and second one-way valves are provided in the tubing at opposite ends of the pump structure. A hollow member having an outer diameter less than the inner diameter of the tubing is disposed within the tubing and connected to a string of sucker rods for reciprocation. The hollow member is sealed to the inner surface of the tubing by a pack-off assembly which divides the volume between the upper and lower plungers into separate pumping chambers. The hollow member includes fluid passages above the pack-off assembly to provide fluid communication with the upper chamber so that during an up stroke fluid is drawn through the first valve into the lower chamber and, during a down stroke, fluid is expelled by way of the second valve carried on the upper plunger, from the lower chamber through the hollow member and from the upper chamber via the fluid passages and upward through the second valve and into the tubing above the second valve.

During installation, the pack-off assembly is pushed into the tubing by the upper plunger and sealed thereto by the way of annular friction seating rings on the body seating member of the body of the anchorable pack-off assembly. At times, it was found, that there was a difficulty in installation. The sizing of the friction seating rings on the body of the anchorable pack-off assembly is particularly critical. If these rings are a few thousandths of an inch too small, the pressure of the upper plunger pumping thereagainst during operation of the pump would displace the assembly. If the friction seating rings are a few thousandths of an inch too large, the assembly cannot be forced into the barrel. This problem is compounded by the American Petroleum Institute's allowable tolerance of the sizing of working barrels, which is the nominal size, +0.005", thus making a tolerance range of 0.010".

SUMMARY OF THE INVENTION

The object of the present invention, therefore, is to provide an improved anchorable pack-off assembly which overcomes the aforementioned installation problems, and to provide a method for seating the pack-off assembly.

According to the present invention, the above objects are achieved by the addition of a slidable tapered cone below the bottom seating ring. The tapered cone comprises a sleeve tapered to a sharp edge and constitutes an annular wedge installed on the anchorable pack-off assembly body with the smaller end up. Also, the lower end of the anchorable pack-off assembly body is provided with a left-hand thread and a left-hand threaded nut thereon. The lower edge of the nut includes two notches 180° apart. A coupling on top of the lower plunger, which couples the plunger to the hollow rod, is made with two lugs on its top end 180° apart.

To install the improved anchorable pack-off assembly, as before, the assembly on the hollow rod between the two plungers is lowered via the string of pump sucker rods down into the pump barrel where the upper plunger engages and forces the anchorable pack-off assembly into the barrel and pushes it into a desired anchoring location. The friction seating rings are tight enough against the anchorable pack-off assembly body and the barrel to cause interim anchoring to maintain the anchorable pack-off assembly in place. The string of pump sucker rods are raised until the lugs on top of the lower plunger come into contact with the bottom of the left-hand threaded nut at the bottom of the anchorable pack-off assembly body. By turning the string of pump sucker rods, from above ground, in a right-hand direction (counter-clockwise as viewed into the well bore), the lugs on the coupling engage the notches on the lower end of the nut causing the nut to turn and advance on the threads and push the tapered cone upwardly with its tapered smaller end entering between the lower friction seating ring and the seating member of the anchorable pack-off assembly body and causing the friction ring to be radially expanded circumferentially thereabout and wedging it more tightly against the barrel, thus effecting increased anchoring forces.

The above improvement per se works well in high fluid level wells that remain high fluid wells. Sometimes, however, in a well where, after a time, the fluid level has been lowered to a point where both chambers of the pump do not completely fill at the end of the up stroke of the pump, there is a condition known as "fluid pound". When this condition exists, the plungers on the down stroke hit fluid and before the upper ball can be forced off the seat, sufficient pressure must be generated to overcome approximately 400 pounds of pressure per square inch of the plunger area per 1000 feet of well depth. This severe pounding, jarring, or hammering effect makes it difficult to maintain anchoring of the anchorable pack-off assembly. It is therefore another object of the invention to provide a pump structure for an anchorable pack-off assembly which overcomes the problem of fluid pound, and a method for installing such a pump structure.

According to the invention, this object of overcoming the problem of fluid pound is achieved in that, instead of using a one-piece barrel, two shorter barrels are used and connected with a coupling. The holes that were formally in the barrel are now provided in the coupling. Near the center of the coupling is a tapered reduced inner diameter area. This area is a few thousandths of an inch smaller than the inner diameter of the barrel, for example 0.008"–0.009" smaller. Spring-type plunger rings are used on the lower plunger, which rings are known in the art as Flexite rings or pressure-actuated rings. These rings are made of a hard, springy composition. By making the slotted nut on the bottom of the anchorable pack-off assembly a few thousandths of an inch, for example, 0.004"-0.005" smaller than the barrel, but larger than the reduced diameter of the pump barrel provided by the coupling, the lower plunger can be lowered through the coupling. The spring-type plunger rings will compress a few thousandths of an inch while passing through and spring back to original size against the inner surface of the pump barrel. After the pump is placed into service, if at any time the well fluid is lowered to a point where a fluid pound exists sufficiently to move the anchorable pack-off assembly downwardly, the nut will move against the reduced diameter in the coupling and stop, because of the few thousandths of an inch difference in diameter.

BRIEF DESCRIPTION OF THE DRAWINGS

Other objects, features and advantages of the invention, its organization, construction and operation will be best understood from the following detailed description, taken in conjunction with the accompanying drawings, on which:

FIG. 1 is a schematic elevation of a pumped oil well of the type which may incorporate the present invention;

FIG. 2 is a longitudinal sectional view taken through an oil well pump constructed and operating in accordance with the present invention, shown at the initiation of an up stroke;

FIG. 3 is a sectional view similar to that illustrated in FIG. 1 at the initiation of, or at least during, a down stroke of the pump;

FIG. 4 is a sectional view taken substantially along the parting line IV—IV of FIG. 2; and FIG. 5 is a sectional view taken substantially along the parting line V—V of FIG. 2.

DESCRIPTION OF THE PREFERRED EMBODIMENTS

Referring to FIG. 1, oil well pump apparatus is generally illustrated at 10 in which a well bore 14 is located in the ground 12 and includes therein a tube 16 constructed of a plurality of hollow well tubing which, as is well known in the art, is normally constructed of a plurality of end-to-end connected tubes. Forming a part of the tube 16 and located below ground at a desired pumping location is a pump 18. The pump 18 is a reciprocating pump which is reciprocated by a reciprocating member 22. The reciprocating member 22 is, as is well known in the art, a series of end-to-end connected sucker rods known as a string of sucker rods. The reciprocating member 22 is reciprocated by a rocking boom 24, as indicated by the double-headed arrow 23. The boom 24 is rocked or pivoted by a prime mover 26, which is usually an electric motor or an internal combustion engine driving an eccentric mechanism, as shown.

Referring to FIGS. 2 and 3, the pump 18 is illustrated as comprising a hollow rod 28 mounted for reciprocation in a pump barrel 30. The hollow rod 28 includes a plurality of bores 29 therethrough for supporting a flow of fluid between the interior and the exterior of the rod 28, as specifically set forth and described in the aforementioned U.S. Pat. No. 3,945,774 which is relied on here for a description of the pumping action for reasons of simplicity and clarity in that the pumping action forms no part of the present invention.

The hollow rod 28 carries, at its lower end, a plunger or piston 32 which is fluid sealed to the inner surface of the barrel 30 by way of a pair of seal rings 42, the lower piston 32 being positioned above a first one-way valve 34 which is mounted in the barrel 30. At its upper end, the hollow rod 28 carries an upper plunger or piston 36 which is fluid sealed to the inner surface of the barrel 30 by way of a pair of seal rings 40. The upper plunger or piston is connected to the string of sucker rods 22 for reciprocation by way of a second one-way valve 38.

The hollow rod 28 reciprocates in the pump barrel through a pack-off assembly 44 which divides the pump barrel into upper and lower chambers. The pack-off assembly 44 comprises an elongate hollow body 54 which mounts a plurality of packing members 46 for sealing with respect to the hollow rod 28. The elongate body 54 also comprises a reduced diameter section terminated at its upper extent by a shoulder 56 against which a series of alternating seals 48 and spacers 50 is disposed.

As mentioned above, an object of the present invention is to provide an improved method and structure for seating the pack-off assembly. To this end, the lower end of the elongate hollow body 54 comprises a threaded section 56 having a nut 58 threaded thereon against a lower end 62 of an annular wedge or conical sleeve 60 which tapers to a sharp upper end 64. As will be appreciated from the drawing, advancement of the nut 58 upwardly against the end 62 of the annular wedge 60 causes the sharp end 64 to enter between the lowest annular seal ring 48 and further entry of the wedge 60 causes expansion of the lowest annular seal ring 48 radially about its entire circumference to tightly wedge against the inner surface of the barrel 30.

Inasmuch as the pump is well below ground, and the internal components of the pump are moved into a desired location in a "loose" condition from above ground in which the hollow rod 28 carrying the upper and lower pistons is lowered down into the tube 16 and into the pump barrel 30 carrying the pack-off assembly 44 therewith, and as the upper piston is employed to push the pack-off assembly 44 into the desired location, some structure must be provided for advancing the nut 58 after the pack-off assembly has been pushed to the desired location. This structure includes the string of sucker rods 22, the upper oneway valve 38, the upper piston 36, the hollow rod 28 and the lower piston 32.

Attention is invited that the lower end of the nut 58 includes a pair of recesses 66 for receiving corresponding lugs 68 which are provided on the upper surface of the lower piston 32. Therefore, after the pack-off assembly 44 has been placed in the desired location, the string of sucker rods is raised until the upper surface of the piston 32 contacts the lower end of the nut 58. Then, upon rotation of the string of sucker rods, while maintaining an upward tension on the string of sucker rods, the lugs 68 are received in the recesses 66 to turn the nut 58. Inasmuch as it is normal to provide right-hand threads for connection of the other components of the pump, as viewed from above, a corresponding rotation of the sucker rods, as viewed from below, would be risky with respect to loosening or detachment, the threaded section 56 and the nut 58 are therefore provided with left-hand threads and the sucker rods are rotated to the right, above ground, as indicated by the arcuate arrow 70. As pointed out above, advancement of the nut 58 causes the annular wedge or conical sleeve 60 to expand the lower seal ring 48 and provide an improved anchoring over that heretofore known.

With respect to fluid pound conditions, as mentioned above, which could hammer the pack-off assembly 44 downwardly, a further improvement is provided for limiting the downward movement of the pack-off assembly. This improvement resides in the provision of the pump barrel 30 as a two-piece structure including an upper barrel section 70 and a lower barrel section 72 which are coupled together by way of a coupling 74 which includes a plurality of holes 78 therethrough which are equivalent to the openings 128 and 130 of the aforementioned U.S. Pat. No. 3,945,774 for lubrication of the lower piston 32 and breathing of the pump apparatus. The coupling 74 includes a central portion of reduced diameter and a tapered surface 76, which tapers outwardly away from the central axis, the bores 78 being provided through the portion of reduced diameter. Upon the occurrence of a fluid pound condition, the pack-off assembly can only be minimally moved in that the tapered section acts as a lower limit for the nut 58 due to the reduced internal diameter of the pump at this location.

Inasmuch as the lower plunger or piston 32 must reside below the openings 78, the same must pass through the reduced diameter section. This is accomplished by the provision of the diameter of the piston 32 slightly less than the diameter of the reduced diameter section and by providing the seal rings 42 as spring-type or pressure-actuated rings. As the piston is moved downwardly into the pump barrel, the spring-type seal rings 42 will engage and yield to the tapered surface 76 to permit the piston 32 to pass through the reduced diameter section and then, after such passage, expand again against the inner surface of the lower pump barrel section 72.

In order to enable initial compression of the spring-type rings 42 for assembly or for maintenance of the pump, it should be noted that entry to the reduced area section from either direction is by way of a respective arcuate shoulder 80, 82.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. In an anchorable pack-off assembly of the type in which a seating member body carries at least one one-piece annular friction seating and sealing ring for engaging the inner surface of the pump barrel and is mounted between upper and lower plungers which are connected to one another via a reciprocation member, and in which the reciprocation member passes through the seating member, and in which the upper plunger is connected to a string of sucker rods for reciprocation, the improvement for fluid-sealed anchoring of the pack-off assembly, the improvement comprising: a threaded section on the seating member spaced from the at least one one-piece friction seating and sealing ring;

a hollow sleeve slidably mounted on the seating member adjacent the at least one one-piece friction seating and sealing ring, said hollow sleeve including a first end, a second end adjacent said at least one one-piece friction seating and sealing ring, and a taper defining said second end as a sharp annular ring terminating an annular wedge;

a threaded member on said threaded section and rotatable to advance thereon to engage said first end and slide said hollow sleeve on said seating member so that said second end thereof is forced between said seating member and said at least one one-piece annular friction seating and sealing ring to simultaneously radially and circumferentially expand said at least one one-piece friction seating and sealing ring and tightly engage the same in fluid-sealed engagement with the inner surface of the pump barrel.

2. The improved anchorable pack-off assembly of claim 1, wherein:

said threaded section is located below the at least one friction seating ring; and said first end of said hollow sleeve is a lower end, said second end is an upper end, and said hollow sleeve is a hollow conical sleeve with said taper extending from said lower end to said upper end.

3. The improved anchorable pack-off assembly of claim 1, wherein:

said threaded member is a nut including a bottom end comprising recess means therein; and the lower plunger comprises an upper end including lug means thereon to be received in said recess means by which said nut may be rotated by rotating said lower plunger via the reciprocation member, the upper plunger and the sucker rods.

4. The improved anchorable pack-off assembly of claim 3, wherein:

said recess means comprises and defines a pair of recesses located 180° apart; and said lug means comprises a pair of lugs located 180° apart.

5. The improved anchorable pack-off assembly of claim 1, wherein:

said threaded section and said threaded member comprise complementary left-hand threads.

6. In a well pump of the type in which a hollow elongate pump barrel is located in a well bore and has an upper plunger fluid-sealed to the inner surface of the pump barrel and is connected to a string of sucker rods for reciprocation in the pump barrel, a lower plunger is mounted to the upper plunger by a hollow rod for reciprocation therewith, in which the lower plunger is fluid sealed to the inner surface of the hollow elongate pump barrel, in which the hollow rod is fluid sealed to mounted to reciprocate through a pack-off assembly which is fluid sealed to the inner surface of the hollow elongate pump barrel and divides the barrel into upper and lower pumping chambers, in which a first one-way valve is mounted in the hollow elongate pump barrel below and spaced from the lower plunger and permits upward fluid flow, in which the upper plunger includes a vertical bore therethrough and carries a second one-way valve in communication with the interior of the hollow rod via the bore for permitting upward fluid flow, in which the hollow rod includes radial bores communicating the interior thereof with the upper pumping chamber, and in which the elongate hollow pump barrel comprises radial breather and lubricating bores communicating the lower pumping chamber with the well bore, above the first one-way valve, the improvement wherein:

the hollow elongate pump barrel comprises upper and lower barrel sections and a coupling joining said upper and lower barrel sections, said pack-off assembly mounted in said upper barrel section;

said coupling includes the breather and lubricating holes and an inner surface comprising a tapered section which effectively reduces the inner diameter of the barrel;

said pack-off assembly is lowered by said sucker rods into said upper barrel section and includes sealing and seating means operated by said sucker rods to fluid seal and seat said pack-off assembly against the inner surface of said upper barrel section;

the at least one seal ring of the lower plunger comprises a radially-flexible compression seal ring which is compressed by the reduced inner diameter of the tapered section to permit passage of the lower plunger therethrough as the lower plunger is moved down into the lower pump barrel section by lowering the sucker rods and then expands against the inner surface of said lower barrel section after passing said tapered section; and said tapered section includes and constitutes a stop for the bottom of the body of the pack-off assembly in response to a downward movement of the pack-off assembly downwardly through the upper barrel section due to the occurrence of a fluid pound condition which hammers the pack-off assembly downwardly in the upper pump barrel section.

7. Well pump apparatus for connection to and operation by a reciprocating string of sucker rods which extend downwardly into well tubing, comprising:

an outer pump casing including an elongate hollow pump barrel which has an inner surface and is constituted by a portion of the well tubing;

a one-way first valve mounted within said pump barrel permitting upward fluid flow;

a hollow member of lesser outer diameter than the inner diameter of said pump barrel disposed within said pump barrel and connected to said string of sucker rods for reciprocation;

lower and upper plungers carried by said hollow member above said first valve in spaced relation and in sealed sliding engagement with said inner surface of said pump barrel, each of said plungers having a fluid passageway therein in fluid communication with an defining a fluid communication path with said hollow member and said first valve;

a one-way second valve mounted for reciprocation with said hollow member and operable to provide communication between said fluid communication path and the interior of said pump barrel above said upper plunger; and a pack-off assembly anchored in a forced fit in fluid-sealed relation within and with respect to the inner surface of said pump barrel, said pack-off assembly forced into its anchoring position by said upper plunger and removed therefrom by said lower plunger in response to a downward force and an upward force, respectively, applied to the string of sucker rods;

said pack-off assembly including chamber dividing means receiving said hollow member in sealed sliding engagement between said upper and lower plungers to form upper and lower pumping chambers of equal diameter in said pump barrel, said chamber dividing means comprising an annular friction seating body and at least one one-piece annular friction seating and sealing ring carried by and about said friction seating body for seating and fluid sealing against said inner surface of said pump barrel, a tapered conical sleeve slidably mounted on said annular friction seating body adjacent said at least one one-piece annular friction seating and sealing ring and including a first end, a second end adjacent said one one-piece annular friction seating and sealing ring and a taper extending from said first end to a sharp edge constituting said second end, and means carried on said annular friction seating body for forcing said conical sleeve between said annular friction seating body and said at least one one-piece annular friction seating and sealing ring to radially expand said at least one one-piece friction seating and sealing ring into fluid-tight anchored engagement with said inner surface of said pump barrel, said hollow member including fluid passage means above said pack-off assembly providing communication of the fluid communication path with said upper chamber, whereby, during an up stroke, fluid is drawn through said first valve into said lower chamber and via said fluid communication path and said fluid passage means into said upper chamber and, during a down stroke, fluid is expelled via said second valve from said lower chamber via said fluid communication path and from said upper chamber via said fluid passage means and said fluid communication path upwardly through said pump barrel.

8. A method of sealing off and dividing a pump barrel, located below ground in a well bore, into upper and lower pumping chambers by anchoring a pack-off assembly of a pump structure to the inner surface of the pump barrel, the pump structure comprising a hollow rod slidably mounted through the body of the pack-off assembly, upper and lower pistons mounted to respective ends of the hollow rod, the lower piston including lugs on its upper surface, a one-piece annular friction seating and fluid sealing ring having an outer diameter larger than the inner diameter of the pump barrel carried about the body of the pack-off assembly, a threaded lower end on the body of the pack-off assembly, a conical sleeve slidable on the body of the pack-off assembly and including an upper end adjacent the one-piece annular friction seating and fluid-sealing ring and a taper extending radially outwardly to a lower end, and a nut on the threaded section including a bottom having recesses therein, the method comprising the steps of:

connecting the upper piston of the pump structure to and lowering the pump structure down into the well by a string of rods, normally used to reciprocate the pistons and the hollow rod, until the one-piece friction seating and fluid-sealing ring engages the pump barrel;

moving the string of rods downwardly to engage the upper piston with the body of the pack-off assembly and force the pack-off assembly downwardly into the pump barrel to a desired location for anchoring;

moving the string of rods upwardly until the lower piston engages the nut on the pack-off assembly;

rotating the string of rods from above ground while maintaining an upward tension thereon to engage the lugs of lower piston into the recesses in the nut; and further rotating the string of rods from above ground to advance the nut against the conical sleeve and wedge the conical sleeve between the body of the pack-off assembly and the one-piece annular friction seating and fluid-sealing ring to radially expand the one-piece friction seating and fluid-sealing ring and thereby simultaneously tightly anchor and fluid seal the pack-off assembly against the inner surface of the pump barrel.

9. In an oil well pump of the type in which a pump barrel is located below ground in a well bore and the pump is normally operated to pump oil by a string of movable rods which extend from above ground to a piston means slidable in the pump barrel, and in which the piston means includes upper and lower spaced pistons connected by a hollow rod which is slidable through the body of a pack-off assembly, the pack-off assembly dividing the pump barrel into upper and lower pumping chambers, the improvement therein comprising:

an annular expandable means mounted about the body of the pack-off assembly, said annular expandable means including a one-piece annular friction sealing and seating ring; and operating means coupled to said annular expandable means and to the string of rods for causing circumferentially-extending radial expansion of said one-piece annular friction sealing and seating ring upon movement rotation of the string of rods from above ground to simultaneously tightly anchor and fluid seal the pack-off assembly to the interior of the pump barrel.

10. The improved oil well pump of claim 9, wherein said movable means comprises:

a threaded section on the body of the pack-off assembly adjacent said conical sleeve;

a threaded nut threaded onto said threaded section for rotation and axial movement thereon to engage said conical sleeve, said nut including recesses therein; and lugs on one of the pistons for engaging in the recesses for turning the nut and moving said conical sleeve in-between the body of the pack-off assembly and said friction sealing and seating ring.

11. An oil well pump comprising:

elongate tubing extending downwardly into a well bore and including a pump barrel;

a string of sucker rods adapted for rotation and reciprocation and extending downwardly into said elongate tubing;

a one-way first valve mounted in said pump barrel permitting upward fluid flow;

a hollow member having an outer diameter less than the inner diameter of said pump barrel disposed within said pump barrel and connected to said string of sucker rods for reciprocation;

upper and lower pistons carried by said hollow member above said first valve mounted in spaced relation and in sealed sliding engagement with the inner surface of said pump barrel, each of said pistons including a fluid passageway therethrough in a fluid communication path with said hollow member and said first valve;

a one-way second valve mounted to said first piston and connected to said string of sucker rods for reciprocation and operable to provide upward fluid communication between said fluid communication path the interior of said pump barrel above said upper piston; and a pack-off assembly anchored in a force fit in fluid-sealed relation within and with respect to the inner surface of said pump barrel, said pack-off assembly forced into its anchoring position by said upper piston and removed from its anchored position by said lower piston in response to a downward force and an upward force, respectively, applied to said string of sucker rods;

said pack-off assembly comprising a cylindrical body carrying at least one one-piece friction seating and sealing ring thereabout engaging the inner surface of said pump barrel in a fluid-sealed relationship, said cylindrical body receiving said hollow member therethrough in sealed sliding engagement between said upper and lower pistons to form upper and lower pumping chambers in said pump barrel, a conical sleeve slidably mounted on said cylindrical body below said at least one one-piece friction seating and sealing ring and positioned to extend between said cylindrical body and said at least one one-piece friction seating and sealing ring to force and expand said at least one one-piece friction seating and sealing ring radially outward about its entire circumference to simultaneously tightly anchor and fluid seal said pack-off assembly within said pump barrel, a threaded section on said cylindrical body below said conical sleeve, and a nut on said threaded section for forcing said conical sleeve upwardly to expand said at least one friction seating and sealing ring, said nut including recesses therein, said lower piston comprising lugs thereon for engaging in said recesses and for turning said nut in response to upward tension and rotation of said string of sucker rods, and said hollow member including fluid passage means above said pack-off assembly providing communication of the fluid communication path and the upper pumping chamber, whereby during an up stroke, fluid is drawn through said first valve into said lower pumping chamber and via said fluid communication path and said fluid passage means into said upper pumping chamber, and, during a down stroke, fluid is expelled via said second valve from said lower pumping chamber via said fluid communication path and from said upper pumping chamber via said fluid passage means and said fluid communication path upwardly through said pump barrel.

12. An oil well pump comprising:

elongate tubing extending downwardly into a well bore and including a pump barrel, said pump barrel including upper and lower barrel sections and a coupling ring coupling said upper and lower barrel sections together, said coupling ring including an inner surface having an inwardly-directed tapered section to effectively reduce the inner diameter of said pump barrel and define a stop;

a string of sucker rods adapted for rotation and reciprocation and extending downwardly into said elongate tubing;

a one-way first valve mounted in said pump barrel permitting upward fluid flow; a hollow member having an outer diameter smaller than the inner diameter of said pump barrel disposed within said pump barrel and connected to said string of sucker rods for reciprocation and rotation;

upper and lower pistons carried by said hollow member above said first valve and mounted in spaced relation and in sealed sliding engagement with the inner surface of said pump barrel, each of said pistons including a fluid passageway therethrough in a fluid communication path with said hollow member said first valve;

a one-way second valve mounted to said first piston and connected to said string of sucker rods for reciprocation and operable to provide upward fluid communication between the fluid communication path and the interior of said pump barrel above said upper piston; and a pack-off assembly anchored in fluid-sealed relation within and with respect to the inner surface of said pump barrel, said pack-off assembly forced into its anchored position by said upper piston and removed from its anchored position by said lower piston in response to a downward force and an upward force, respectively, applied to said string of sucker rods;

said pack-off assembly comprising a cylindrical body including a bottom end, said cylindrical body carrying at least one one-piece friction seating and sealing ring thereabout engaging the inner surface of said upper pump barrel section, said bottom end of said cylindrical body being above and spaced from said tapered section of said coupling ring, said cylindrical body receiving said hollow member therethrough in sealed sliding engagement between said upper and lower pistons to form upper and lower pumping chambers in said pump barrel, a conical sleeve slidably mounted on said cylindrical body below said at least one one-piece friction seating and sealing ring and extending between said cylindrical body and said at least one one-piece friction seating and sealing ring forcing and expanding said at least one friction seating and sealing ring radially outward about its entire circumference to simultaneously tightly anchor and fluid seal said pack-off assembly within said upper section of said pump barrel above said tapered section of said coupling ring, a threaded section on said cylindrical body below said conical sleeve, and a nut on said threaded section for forcing said conical sleeve upwardly to expand at least one friction seating and sealing ring, said nut forming said bottom end and including recesses therein, said lower piston comprising lugs thereon for engaging in said recesses for turning said nut in response to upward movement and rotation of said string of sucker rods, said hollow member including fluid passage means above said pack-off assembly providing communication of the fluid communication path and the upper pumping chamber, whereby, during an up stroke, fluid is drawn through said first valve into said lower pumping chamber and via said fluid communication path and said fluid passage means into said upper pumping chamber, and, during a down stroke, fluid is expelled via said second valve from said lower pumping chamber via said fluid communication path and from said upper pumping chamber via said fluid passage means and said fluid communication path upwardly through said pump barrel, said stop provided by said tapered section of said coupling ring in said pump barrel below said pack-off assembly providing a lower limit for engagement by said nut upon downward movement of said pack-off assembly through said upper barrel section in response to a fluid pound condition.

* * * * *